US011346188B2

(12) United States Patent
Affleck et al.

(10) Patent No.: US 11,346,188 B2
(45) Date of Patent: May 31, 2022

(54) DEPLOYING A LINER IN A WELLBORE

(71) Applicant: SAUDI ARABIAN OIL COMPANY, Dhahran (SA)

(72) Inventors: Michael Affleck, Aberdeenshire (GB); Timothy E. Moellendick, Dhahran (SA); Scott Fraser, Aberdeenshire (GB)

(73) Assignee: Saudi Arabian Oil Company, Dhahran (SA)

( * ) Notice: Subject to any disclaimer, the term of this patent is extended or adjusted under 35 U.S.C. 154(b) by 53 days.

(21) Appl. No.: 16/636,129

(22) PCT Filed: Jul. 27, 2018

(86) PCT No.: PCT/US2018/044095
§ 371 (c)(1),
(2) Date: Feb. 3, 2020

(87) PCT Pub. No.: WO2019/027830
PCT Pub. Date: Feb. 7, 2019

(65) Prior Publication Data

US 2021/0164329 A1 Jun. 3, 2021

Related U.S. Application Data

(60) Provisional application No. 62/540,168, filed on Aug. 2, 2017.

(51) Int. Cl.
*E21B 43/10* (2006.01)
*E21B 21/00* (2006.01)
*E21B 33/138* (2006.01)

(52) U.S. Cl.
CPC ..... *E21B 43/103* (2013.01); *E21B 21/003* (2013.01); *E21B 33/138* (2013.01)

(58) Field of Classification Search
CPC .... E21B 43/103; E21B 43/105; E21B 21/003; E21B 33/138
See application file for complete search history.

(56) References Cited

U.S. PATENT DOCUMENTS 2,927,775 A 3/1960 Hildebrandt
3,422,631 A * 1/1969 Daniel ..... E21B 19/22 405/155

(Continued)

FOREIGN PATENT DOCUMENTS

GB 2357305 6/2001

OTHER PUBLICATIONS

International Search Report and Written Opinion of the International Searching Authority issued in International Application No. PCT/US2018/044095 dated Nov. 29, 2018; 12 pages.

*Primary Examiner* — D. Andrews
(74) *Attorney, Agent, or Firm* — Fish & Richardson P.C.

(57) ABSTRACT

A downhole liner delivery tool includes a housing configured to couple to a tubular work string. The housing includes an interior volume. The tool also includes a liner store enclosed within the interior volume. The liner store is configured to enclose at least a portion of a wellbore liner that includes a flexible membrane. The flexible membrane includes an imbedded epoxy. The tool also includes a hydraulic circulation system arranged in at least a portion of the interior volume and configured to circulate a fluid to expand the wellbore liner from the liner store to an exterior of the housing to contactingly engage a wellbore wall.

32 Claims, 10 Drawing Sheets

(56) References Cited

U.S. PATENT DOCUMENTS

| | | | | |
|---|---|---|---|---|
| 4,191,493 | A | 3/1980 | Hansson | |
| 5,388,648 | A | 2/1995 | Jordan | |
| 5,501,248 | A | 3/1996 | Kiest | |
| 5,853,049 | A | 12/1998 | Keller | |
| 6,012,526 | A | 1/2000 | Jennings et al. | |
| 8,567,491 | B2 * | 10/2013 | Lurie | E21B 7/20 166/107 |
| 2006/0130922 | A1 * | 6/2006 | Kamiyama | E21B 41/0042 138/98 |
| 2009/0178809 | A1 | 7/2009 | Jeffryes et al. | |
| 2011/0120732 | A1 | 5/2011 | Lurie | |

* cited by examiner

DEPLOYING A LINER IN A WELLBORE

CLAIM OF PRIORITY

This application is a U.S. National Stage of PCT/US2018/044095 filed on Jul. 27, 2018, which claims priority to U.S. Provisional Patent Application No. 62/540,168, filed on Aug. 2, 2017, and entitled "Deploying a Liner in a Wellbore," the entire contents of which are incorporated by reference herein.

TECHNICAL FIELD

The present disclosure relates to apparatus, systems, and methods for deploying a liner in a wellbore.

BACKGROUND

Drilling fluid loss mitigation and consequence can be temporally and economically inefficient. When unacceptable drilling fluid losses are encountered, conventional lost circulation technologies are deployed into the drilling fluid from a terranean surface. The drilling fluid, which includes loss mitigation chemicals, is pumped downhole as part of the standard well circulation system. The modified drilling fluid passes through the bottom hole assembly (BHA), including a drill bit, or bypasses the BHA through a circulation port and is ultimately designed to plug (for example, pressure seal) the exposed formation at a location in the wellbore in which losses are occurring. Once sealing of the wellbore has occurred and acceptable fluid loss control is established, drilling operations may resume. Conventional lost circulation material (LCM) may seal uniformly shaped formation voids (for example, widths) up to approximately 4-6 millimeters (mm) but struggle with un-uniform and larger voids. Effective sealing is often both challenging and costly.

In addition to replacing costly drilling fluid, drilling operations may need to cease in order to take time resolving the fluid losses before continuing to drill into a subterranean zone. Such measures may include pumping increasingly coarse grades of LCM, junk plugs, attempting to cement over the loss point or running casing to place the loss-inducing formation behind steel and squeezing a cement isolating barrier.

SUMMARY

In an example implementation, a downhole liner delivery tool includes a housing configured to couple to a tubular work string. The housing includes an interior volume. The tool also includes a liner store enclosed within the interior volume. The liner store is configured to enclose at least a portion of a wellbore liner that includes a flexible membrane. The flexible membrane includes an imbedded epoxy. The tool also includes a hydraulic circulation system arranged in at least a portion of the interior volume and configured to circulate a fluid to expand the wellbore liner from the liner store to an exterior of the housing to contactingly engage a wellbore wall.

In an aspect combinable with the general implementation, the imbedded epoxy is applied to a first surface of the wellbore liner.

In another aspect combinable with any of the previous aspects, the wellbore liner is positioned in the liner store such that the first surface of the wellbore liner contactingly engages the wellbore wall upon expansion of the wellbore liner from the liner store by the hydraulic circulation store.

In another aspect combinable with any of the previous aspects, the wellbore liner is arranged in the liner store in a folded position.

In another aspect combinable with any of the previous aspects, the folded position includes one of a transverse perpendicular folded position, a longitudinal perpendicular folded position, or a transverse parallel folded position.

In another aspect combinable with any of the previous aspects, the imbedded epoxy includes at least one of a waterborne epoxy resin, an Araldite® or Kerimid® resin, or a high temperature polyimide resin.

In another aspect combinable with any of the previous aspects, the wellbore liner includes a fibrous mesh.

In another aspect combinable with any of the previous aspects, the fibrous mesh includes natural fibers.

Another aspect combinable with any of the previous aspects further includes at least one liner clamp coupled to the housing and configured to hold a free end of the wellbore liner during expansion of the wellbore liner from the liner store to the exterior of the housing.

In another aspect combinable with any of the previous aspects, the at least one liner clamp includes two liner clamps, each liner clamp configured to hold one of a pair of free ends of the wellbore liner during expansion of the wellbore liner from the liner store to the exterior of the housing.

Another aspect combinable with any of the previous aspects further includes at least one roller guide set positioned in the interior volume to receive a portion of the wellbore liner from the liner store during expansion of the wellbore liner from the liner store to the exterior of the housing.

In another aspect combinable with any of the previous aspects, the at least one roller guide set includes a first roller guide set and a second roller guide set, each of the first and second roller guide sets including an axis of rotation that is transverse to an axial dimension of the housing.

In another aspect combinable with any of the previous aspects, the first and second roller guide sets are positioned in proximity to receive the wellbore liner therebetween from the liner store during expansion of the wellbore liner from the liner store to the exterior of the housing.

Another aspect combinable with any of the previous aspects further includes a rupture disk positioned on a downhole axial end of the housing and configured to fluidly isolate the interior volume of the housing from the exterior of the housing.

In another aspect combinable with any of the previous aspects, the rupture disk is further configured to rupture to expose the liner store to the wellbore.

In another aspect combinable with any of the previous aspects, the hydraulic circulation system includes a fluid channel that extends through the housing, and is configured to receive a wellbore fluid from a terranean surface and direct the wellbore fluid to expand the wellbore liner from the liner store to the exterior of the housing.

In another aspect combinable with any of the previous aspects, the fluid channel is configured to direct the wellbore fluid to apply a fluid pressure to a second surface of the wellbore liner that is opposite the first surface of the wellbore liner, to expand the wellbore liner from the liner store to the exterior of the housing.

In another aspect combinable with any of the previous aspects, the hydraulic circulation system includes a fluid piston configured to pressurize a fluid contained in the housing and direct the fluid through the liner store to expand the wellbore liner from the liner store to the exterior of the housing.

Another aspect combinable with any of the previous aspects further includes a resin store enclosed within the housing, the resin store including a volume of a resin material.

Another aspect combinable with any of the previous aspects further includes a plug that fluidly separates the resin from the interior volume.

In another aspect combinable with any of the previous aspects, the plug is configured to break to release the resin to contact the liner.

In another aspect combinable with any of the previous aspects, the wellbore liner includes at least one weak joint.

In another general implementation, a method for deploying a wellbore liner includes running a downhole liner delivery tool into a wellbore on a tubular work string. The downhole liner delivery tool includes a housing configured to couple to the tubular work string and which includes an interior volume. The method further includes circulating a wellbore fluid through the tubular work string to the interior volume of the housing to fluidly contact wellbore liner stored in the downhole liner delivery tool; and with the circulated wellbore fluid, expanding the wellbore liner from a liner store enclosed within the interior volume. The liner store is configured to enclose at least a portion of the wellbore liner. The wellbore liner includes a flexible membrane that includes an imbedded epoxy. The method further includes, with the circulated wellbore fluid, deploying the wellbore liner from the liner store to an exterior of the housing to contactingly engage a wellbore wall.

In an aspect combinable with the general implementation, the imbedded epoxy is applied to a first surface of the wellbore liner.

In another aspect combinable with any of the previous aspects, the wellbore liner is positioned in the liner store such that the first surface of the wellbore liner contactingly engages the wellbore wall upon expansion of the wellbore liner from the liner store by the hydraulic circulation store.

In another aspect combinable with any of the previous aspects, the wellbore liner is arranged in the liner store in a folded position.

In another aspect combinable with any of the previous aspects, the folded position includes one of a transverse perpendicular folded position, a longitudinal perpendicular folded position, or a transverse parallel folded position.

In another aspect combinable with any of the previous aspects, the imbedded epoxy includes at least one of a waterborne epoxy resin, an Araldite® or Kerimid® resin, or a high temperature polyimide resin.

In another aspect combinable with any of the previous aspects, the wellbore liner includes a fibrous mesh.

In another aspect combinable with any of the previous aspects, the fibrous mesh includes natural fibers.

Another aspect combinable with any of the previous aspects further includes holding a free end of the wellbore liner during expansion of the wellbore liner from the liner store to the exterior of the housing with at least one liner clamp coupled to the housing.

Another aspect combinable with any of the previous aspects further includes holding two free ends of the wellbore liner during expansion of the wellbore liner from the liner store to the exterior of the housing with at least two liner clamps coupled to the housing.

Another aspect combinable with any of the previous aspects further includes guiding the wellbore liner through at least one roller guide set positioned in the interior volume during expansion of the wellbore liner from the liner store to the exterior of the housing.

In another aspect combinable with any of the previous aspects, the at least one roller guide set includes a first roller guide set and a second roller guide set, each of the first and second roller guide sets including an axis of rotation that is transverse to an axial dimension of the housing.

In another aspect combinable with any of the previous aspects, the first and second roller guide sets are positioned in proximity to receive the wellbore liner therebetween from the liner store during expansion of the wellbore liner from the liner store to the exterior of the housing.

Another aspect combinable with any of the previous aspects further includes fluidly isolating the interior volume of the housing from the exterior of the housing with a rupture disk positioned on a downhole axial end of the housing.

Another aspect combinable with any of the previous aspects further includes breaking the rupture disk to expose the liner store to the wellbore.

Another aspect combinable with any of the previous aspects further includes circulating the wellbore fluid through a fluid channel that extends through the housing to direct the wellbore fluid to expand the wellbore liner from the liner store to the exterior of the housing.

In another aspect combinable with any of the previous aspects, the fluid channel is configured to direct the wellbore fluid to apply a fluid pressure to a second surface of the wellbore liner that is opposite the first surface of the wellbore liner, to expand the wellbore liner from the liner store to the exterior of the housing.

In another aspect combinable with any of the previous aspects, the downhole liner delivery tool further includes a fluid piston configured to pressurize the wellbore fluid contained in the housing and direct the wellbore fluid through the liner store to expand the wellbore liner from the liner store to the exterior of the housing.

In another aspect combinable with any of the previous aspects, the downhole liner delivery tool further includes a resin store enclosed within the housing, the resin store including a volume of a resin material.

In another aspect combinable with any of the previous aspects, the resin store further includes a plug that fluidly separates the resin from the interior volume.

Another aspect combinable with any of the previous aspects further includes breaking the plug to release the resin to contact the wellbore liner in the wellbore.

Another aspect combinable with any of the previous aspects further includes breaking at least one free end of the wellbore liner; and releasing the wellbore liner into the wellbore.

In another aspect combinable with any of the previous aspects, breaking at least one free end of the wellbore liner includes straining a weak point of the wellbore liner beyond a yield limit.

In another aspect combinable with any of the previous aspects, breaking at least one free end of the wellbore liner includes adjusting a position of the downhole liner delivery tool toward the terranean surface.

Implementations according to the present disclosure may include one or more of the following features. For example, implementations of a downhole liner delivery tool may reduce or mitigate a loss of drilling fluids into a subterranean formation. Further, implementations of a downhole liner delivery tool may provide for a more uniform dimension, or gauge, of a wellbore for drilling operations. Further, implementations of a downhole liner delivery tool may reduce the probability of wellbore collapse where formations are susceptible to such. Further, implementations of a downhole liner delivery tool may create an effective pressure barrier or seal with minimal drilled wellbore diameter reduction. (for example, with a relatively thin liner). Further, implementations of a downhole liner delivery tool may be easily removed or partially removed through mechanical or chemical means if required.

The details of one or more implementations of the subject matter described in this disclosure are set forth in the accompanying drawings and the description. Other features, aspects, and advantages of the subject matter will become apparent from the description, the drawings, and the claims.

DETAILED DESCRIPTION

Figure 1A:
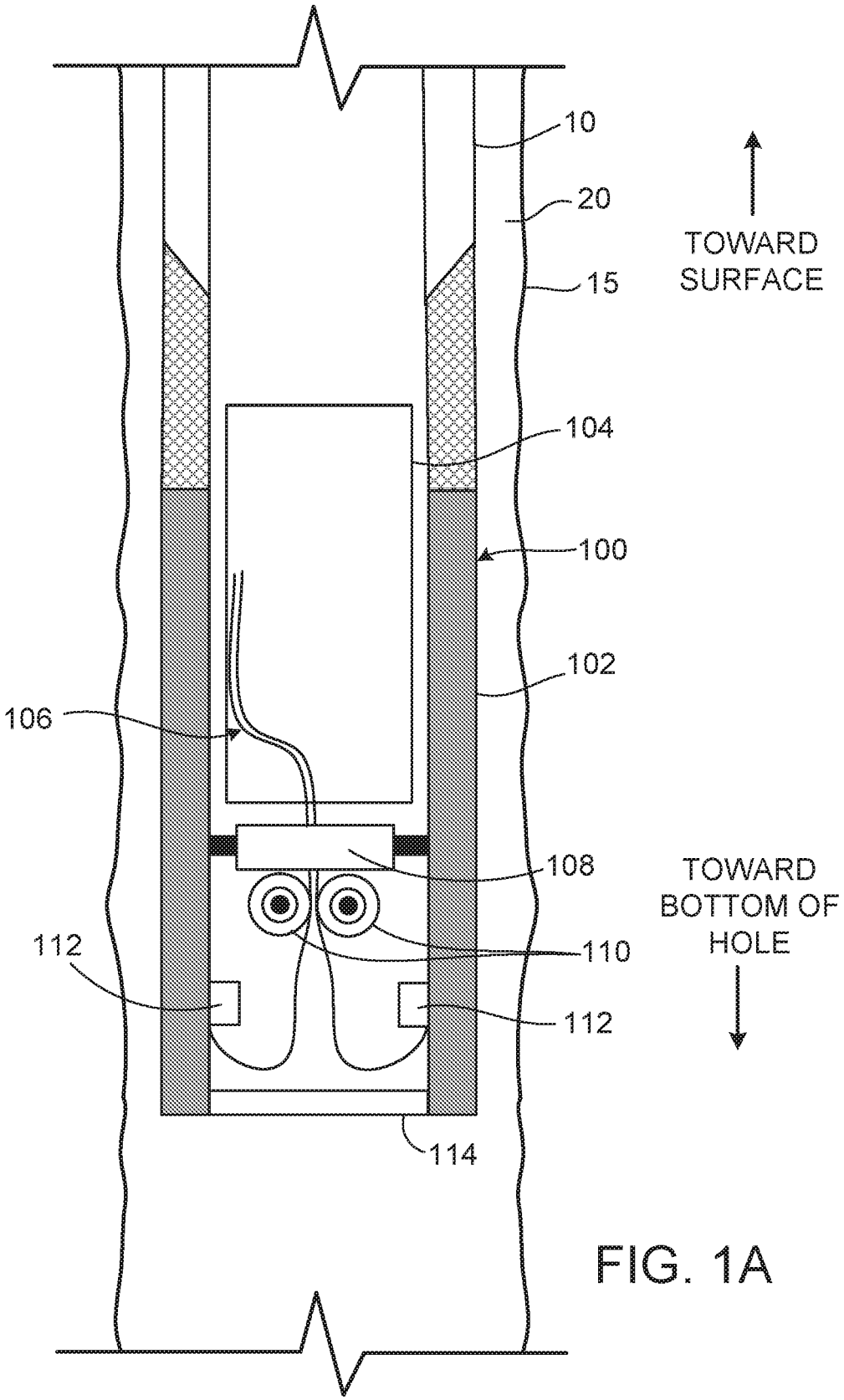
FIGS. 1A-1B are schematic illustrations of an example implementation of a downhole liner delivery tool in an unactuated and actuated state, respectively, according to the present disclosure.
Figure 1B:
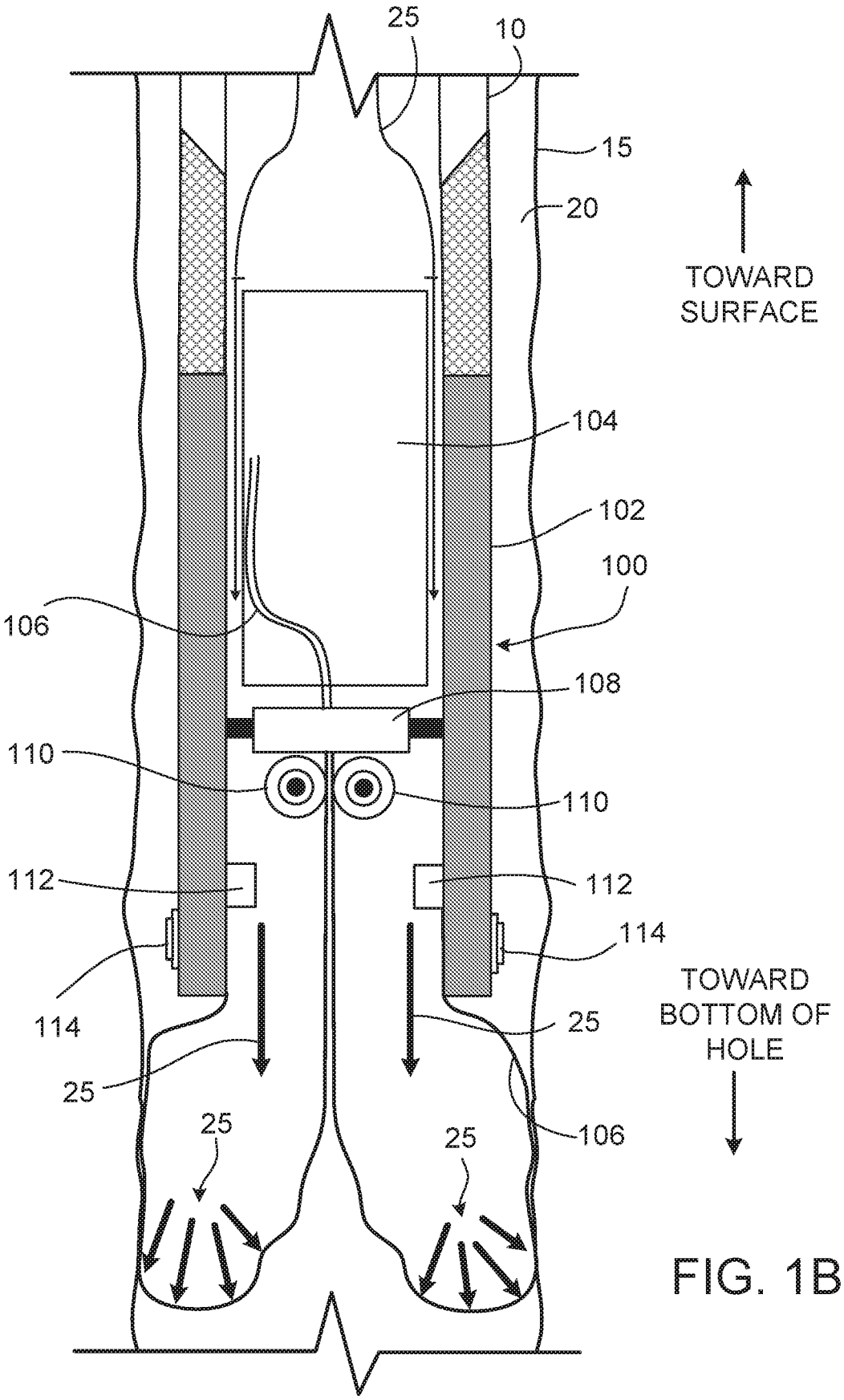

FIGS. 1A-1B are schematic illustrations of an example implementation of a downhole liner delivery tool 100 in an unactuated and actuated state, respectively. Generally, downhole liner delivery tool 100 may be operated to place a non-permeable or semi-permeable membrane across a formation section of a wellbore in a subterranean geologic formation. The membrane, in some aspects, may be capable of reducing drilling fluid losses during a drilling operation to form the wellbore. For example, drilling fluid loss mitigation through use of the membrane system of the downhole liner delivery tool 100 may help speed up drilling operations or continue interrupted drilling operations, or both.

As shown, the downhole liner delivery tool 100 may be run into a wellbore 15 on a work string 10 (for example, a tubular work string that is threadingly coupled to the downhole liner delivery tool 100) or as part of a BHA. The work string 10 that is coupled to the downhole liner delivery tool 100 may be moved through the wellbore 15 to one or more particular depths of the wellbore 15, such as, for example, to a location (or vertically adjacent a location) in which drilling fluid was lost or would be lost into a subterranean (for example, rock formation, geologic formation) from the wellbore 15. Such losses may occur, for example, due to inconsistent wellbore dimensions (for example, varying diameter of the wellbore 15 over a vertical section of the wellbore 15 between a terranean surface and a bottom of the wellbore), low-pressure formations, fissures and fractures, sand, or the geologic properties of the formation.

The example downhole liner delivery tool 100 includes a housing 102 that encloses a liner store 104 (for example, a partially enclosed compartment that is fluidly coupled with an interior volume of the downhole liner delivery tool 100 enclosed by the housing 102 as well as the work string 10) that stores a wellbore liner 106. FIG. 1A shows the downhole liner delivery tool 100 in an unactuated state in the wellbore 15, in which the liner 106 is still mostly or substantially enclosed within the liner store 104. In this state, only a portion of the liner 106 extends from the store 104 and is coupled to clamps 112 that are positioned in the housing 102 of the downhole liner delivery tool 100. For instance, as shown in this example, the liner 106 may be a continuous sheet or panel having two ends. Each of the two ends of the liner 106, in the unactuated state of FIG. 1A, may be coupled to one of the clamps 112 as shown.

As shown in the example of FIG. 1A, ends of the liner 106 are coupled to the clamps 112 so that a portion of the liner 106 extends from the liner store 104. As shown, this portion of the liner 106 that extends from the liner store 104 is fed through a first roller set 108 and a second roller set 110. In this example, the first roller set 108 (which includes two rollers, only one of which is shown in FIG. 1A) is positioned in the housing 102 such that an axis of rotation of the first roller set is parallel to a radial dimension of the downhole liner delivery tool 100. The second roller set 110 (similar or identical to the first roller set 108) includes two rollers through which the liner 106 is fed. The second roller set 110 has an axis of rotation that is also parallel to the radial dimension of the downhole liner delivery tool 100, but perpendicular to the axis of rotation of the first roller set 108.

Generally, the first and second roller sets 108 and 110 comprise or make up a guide or feed system for the liner 106 to ensure during deployment of the liner 106 external to the downhole liner delivery tool 100F104 that the liner 106 moves (for example, is forcibly extended) from the liner store 104 in a controlled manner. As shown, such a system may include roller sets, but other similar friction inducing mechanisms may guide or position the liner 106 while providing a resistance preventing premature or uncontrolled departure of the liner 106 from the liner store 104.

Figure 2B:
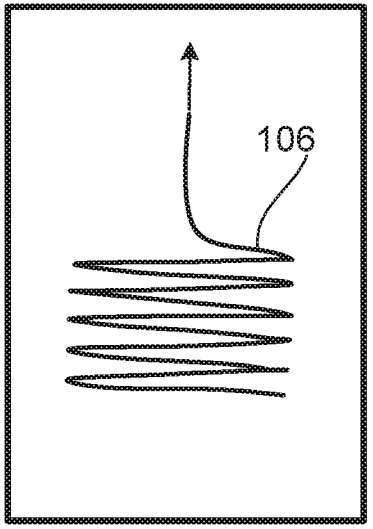
FIGS. 2A-2F are schematic illustrations of an example implementation of a liner store of a downhole liner delivery tool according to the present disclosure.
Figure 2A:
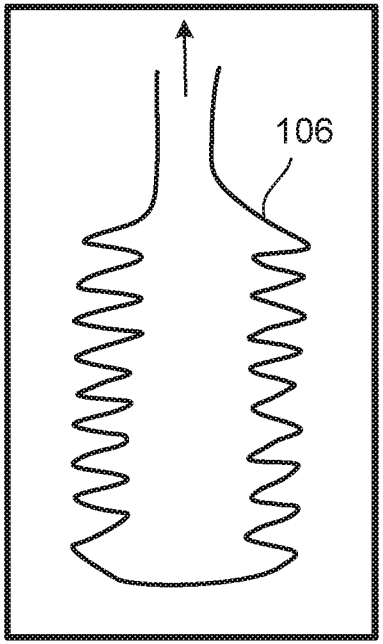
Figure 2C:
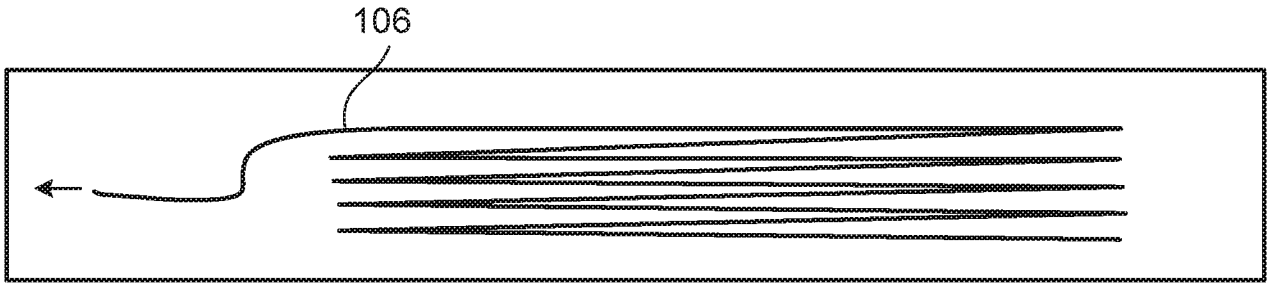
Figure 2D:
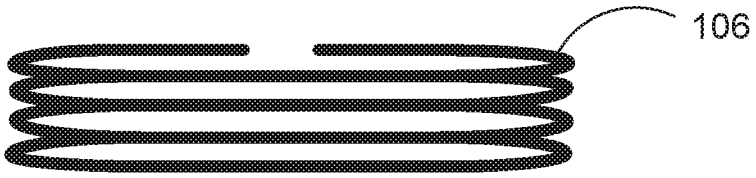
Figure 2E:
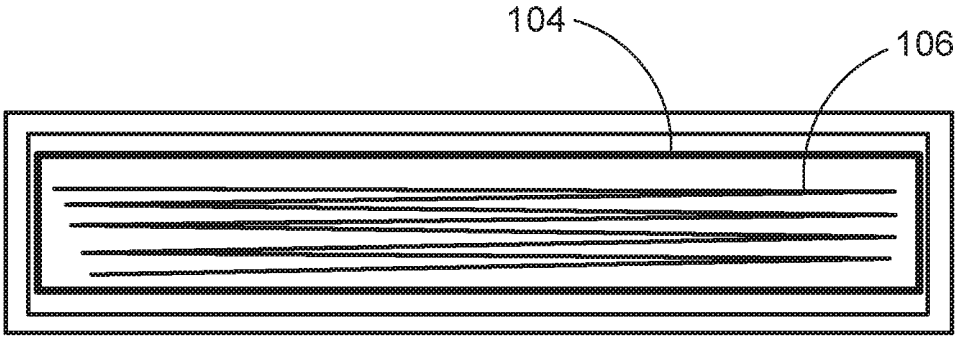
Figure 2F:
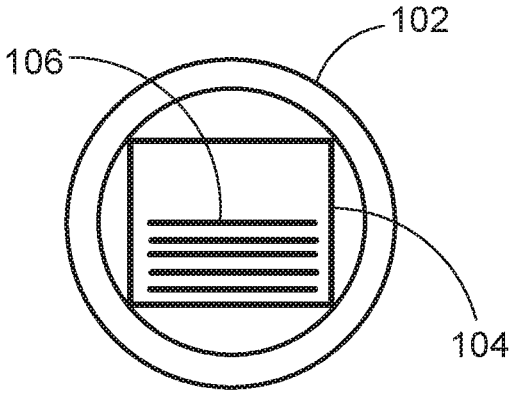

Generally, the liner store 104 secures the liner 106 in transit, for example, when transporting the downhole liner delivery tool 100 to a well site, as well as during a run-in operation of the downhole liner delivery tool 100 into the wellbore 15 (for example, connected to the work string 10). Storage of the liner 106 in the liner store 104 may, for instance, ensure that the liner 106 does not become damaged whilst deploying the downhole liner delivery tool 100 into the wellbore 15. FIGS. 2A-2C are schematic illustrations of an example implementation of a folding configuration for the liner 106 when enclosed within the liner store 104. For example, FIG. 2A shows a liner 106 in a transverse perpendicular fold. FIG. 2B shows a liner 106 in a longitudinal perpendicular fold. FIG. 2C shows a liner 106 in a transverse parallel fold. FIGS. 2D-2F also show example configurations of the liner 106 out of or in the liner store 104. For example, FIG. 2D shows a liner 106 folded in a transverse parallel configuration of four wraps. FIG. 2E shows an example liner 106 folded into a liner store 104. In this example, the liner 106 may be filled with a resin and externally coated with resin (for reasons explained later) to ensure that the resin is located on both sides of the liner 106. FIG. 2F shows a cross-sectional view (for example, looking uphole from within the downhole liner delivery tool 100) of a liner 106 folded to fit within the liner store 104 of the housing 102.

In this example, the liner 106 may be one of several types of semi or non-permeable membranes. For example, the liner 106 may be a flexible (for example, multi-axis bending and expandable) and foldable membrane that is made from natural or man-made fibers. Examples include woven polyester needle felt or glass fiber membranes. The liner 106, in these examples, may also be coated with a liner coating (for example, an epoxy, lubricant, resin, or combination thereof). The liner 106 may be internally or externally coated (or both) with the liner coating to facilitate deployment of the liner 106 into the wellbore 15. The liner coating may be a single or multi set chemical to perform or help the liner 106 perform functions such as, for example, securing the liner 106 to the wellbore 15 upon inversion from the liner store 104, unfolding, and expansion; setting or otherwise increasing the rigidity of the unfolded/expanded liner 106; and acting with the liner "fabric" or mesh to form a pressure seal against the wellbore 15 to mitigate or prevent drilling fluid loss. Suitable coatings may include, but are not limited to the following: waterborne epoxy resin systems designed for concrete surfaces, resin systems with aliphatic amine cross-linkers and resins with amine curing agents (for example, Hexion EPON™ 825, 828, and 813); resins suitable for highly corrosive, high temp applications. (for example, CoREZYN® CORVE 8760); high temperature polyimide resins crosslinked with 2,2'-dimethylbenzidine (DMBZ) stable up to 700° F.; and Araldite® and Kerimid® (polyimide) type resins for high and standard (well deployment) temperature and chemical resistance (for example, Araldite® 2013, 2014 and Kerimid® 701).

As shown, the downhole liner delivery tool 100 also includes a rupture disk 114 positioned to enclose a downhole end of the tool when in the unactuated state as shown in FIG. 1A. The rupture disc 114 (or other form of a breakable member) isolates the liner 106 and other components of the downhole liner delivery tool 100 from wellbore fluids and other debris when running the downhole liner delivery tool 100 into the wellbore 15. Upon reaching a particular liner deployment depth, the rupture disc 114 may be activated (for example, broken to expose the liner 106 to the annulus 20) either through overpressure or another method, allowing the start of the inversion and deployment process for the liner 106 (as shown in FIG. 1B).

FIG. 1B shows the downhole liner delivery tool 100 during an activation process, which otherwise may be described as an inversion and deployment process of the liner 106 into the wellbore 15 from the tool. As shown, the rupture disk 114 has been broken (for example, through an overpressure of a fluid circulated through the downhole liner delivery tool 100) to expose the liner 106 to the annulus 20. A fluid 25 is further circulated (either separately from breaking the disk 114 or as the same overpressure fluid) to forcibly urge the liner 106 from the liner store 104. As shown, the fluid 25 urges the liner 106, still connected at its ends to the clamps 112, from the liner store 104, to contact the wellbore 15. Thus, the liner 106 may be deployed through the use of hydraulics in which the fluid 25 is circulated from the surface to act as a fluid piston to, for example, break the rupture disk 114 and urge the liner 106 from the store 104. In an alternative example, a pressurized fluid may be stored in the downhole liner delivery tool 100 and released (for example, in response to an activation signal from the surface or other signal) to, for example, break the rupture disk 114 and urge the liner 106 from the store 104.

In another example, a combination of hydraulic power and control originating from the surface or the downhole liner delivery tool 100 may be used to activate the tool as shown in FIG. 1B. For example, the liner deployment process (as shown in FIG. 1B) may occur seamlessly through surface control via pump rates, pump pressure or with command type activation of the fluid 25 that inverts the liner 106 and deploys the liner 106 from the liner store 104 (and through the roller systems 108 and 110 and into the annulus 20). In some cases, an existing drilling fluid pumping system can be used. In other cases, a dedicated liner delivery pumping system and fluid may be used to perform the inversion and deployment operation.

In some examples, the downhole liner delivery tool 100 includes a fluid bypass system that allows a wellbore fluid 25 (for example, a drilling fluid) to circulate from the surface to either activate the liner deployment system (shown as inversion pressure) or bypass the downhole liner delivery tool 100 (for example, through adjustable ports in the housing 102, not shown) to exit into the annulus 20. For example, a circulation mode may be adjusted from an "inversion" mode to a "bypass" mode in a fixed sequence. For example, an initial pumping volume runs through the downhole liner delivery tool 100 and after full deployment and release of the liner 106, the remaining fluid is circulated into the annulus 20. In another example, the downhole liner delivery tool 100 may be switched between the inversion mode and the bypass mode. Such control may be implemented in the downhole liner delivery tool 100 or through command from the surface.

Figure 3:
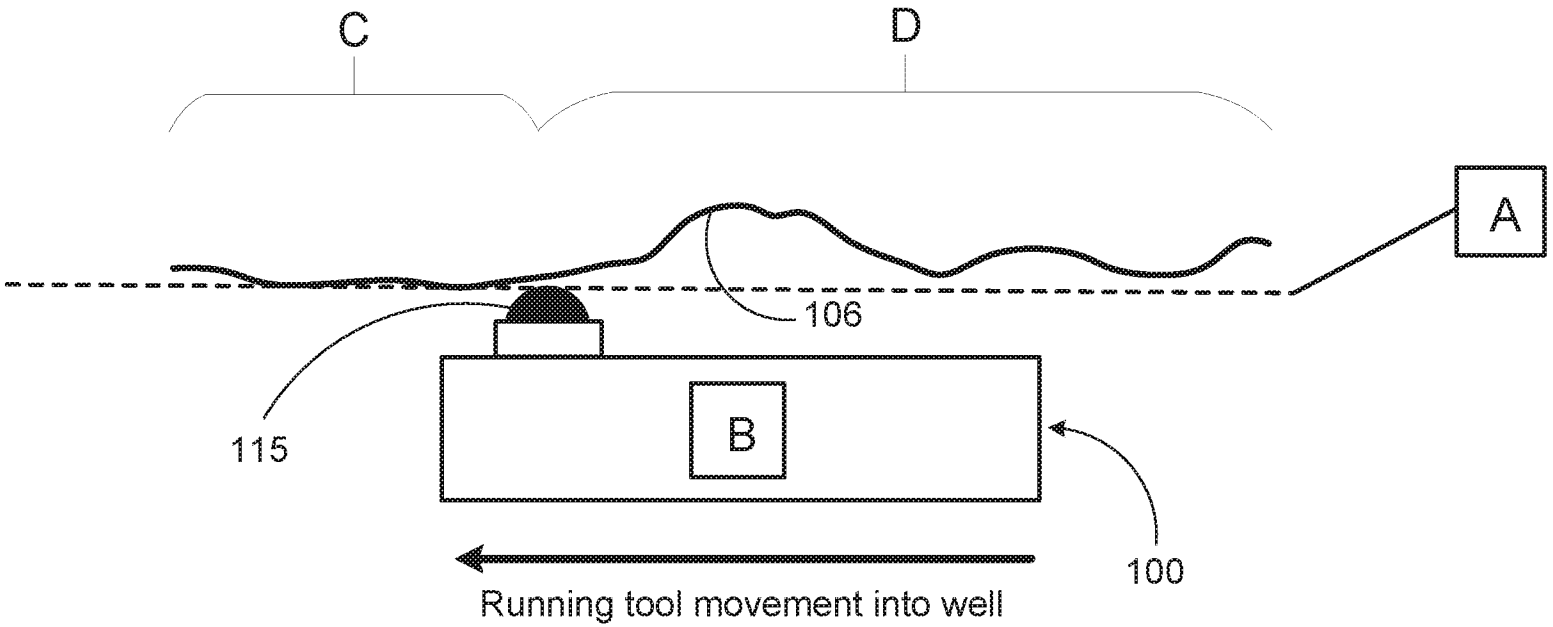
FIG. 3 is a schematic illustration of a portion of a downhole liner delivery tool that includes a gauge polishing device according to the present disclosure.

FIG. 3 is a schematic illustration of a portion of a downhole liner delivery tool that includes one or more gauge polishing devices 114 mounted on the downhole liner delivery tool 100. For example, as shown in FIG. 1B, the downhole liner delivery tool 100 includes a gauge polishing device 115 mounted on an external radial surface in at least two positions (for example, 180 degrees apart on the external housing 102). Generally, each of the gauge polishing devices 114 may function as a mill that is intended to ensure that an internal diameter of the liner 106 that is installed in the wellbore 15 is installed to a dimension larger than a section drill bit gauge. Thus, sections of under-gauge liner will be removed by the gauge polishing device 115 during operation of the downhole liner delivery tool 100. The installed liner 106, even with under gauge elements removed by the gauge polishing device 115, is capable of sustaining pressure integrity at the zones of substantial fluid loss. The gauge polishing device 115 may be of fixed, floating (for example, spring loaded) or control activated design.

As shown in FIG. 3, which provides a close up view of the gauge polishing device 115, "A" is a dashed line that represents the desired wellbore gauge (for example, desired wellbore dimension to accommodate a section drill bit gauge. "B" represents the downhole liner delivery tool 100 with a gauge polishing device 115. "C" represents a section of the lined wellbore where the gauge polishing device 115 will remove a section of the liner 106 that extends past (is a smaller dimension than) the desired wellbore gauge. "D" represents a section of the lined wellbore where the gauge polishing device 115 will not remove a section of the liner 106, because that section does not extend past (is not a smaller dimension than) the desired wellbore gauge.

FIGS. 4A-4E are schematic illustrations of an example implementation of the downhole liner delivery tool 100 during an inversion and deployment operation. For example, the operations described in reference to FIGS. 4A-4E may occur once a BHA has been pulled from the wellbore 15 due to drilling fluid loss. In some examples, prior to beginning the liner deployment operation, an under-reamer may ream across section intervals that have experienced fluid loss in order to allow an additional gap for the liner deployment. In some cases, the downhole liner delivery tool 100 may be a part of or coupled with the BHA, thus making a trip out of the wellbore 15 unnecessary. In other cases, the BHA may be tripped out and replaced with the downhole liner delivery tool 100 to the work string.

Figure 4A:
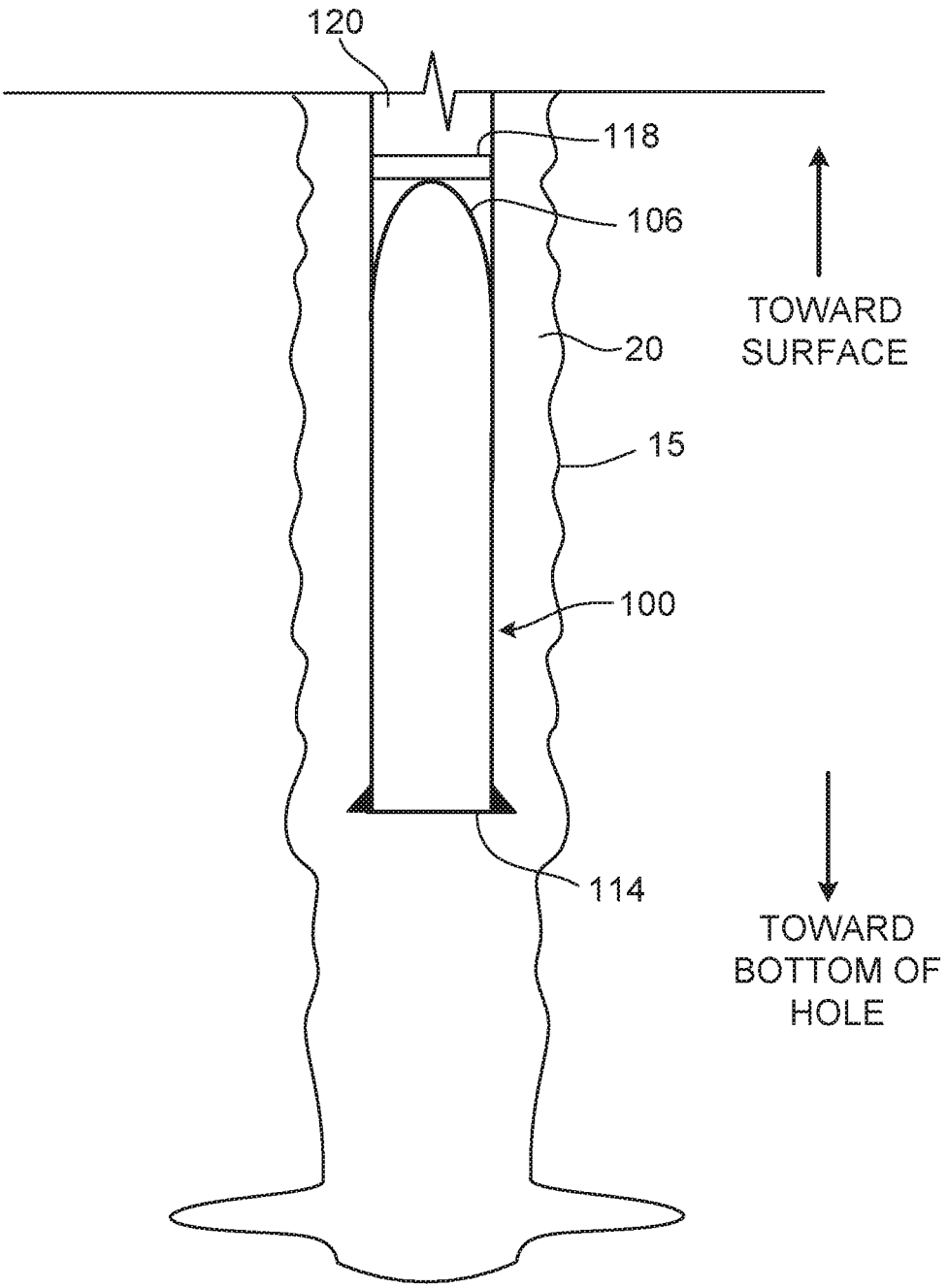
FIGS. 4A-4E are schematic illustrations of an example implementation of a downhole liner delivery tool during operation according to the present disclosure.

FIG. 4A illustrates a first step in the example process. As shown, the downhole liner delivery tool 100 is run in hole (RIH) and positioned uphole of an expected lost circulation zone. In some cases, activation depth may be dependent on a location of expected major lost circulation zone, previous casing shoes, section total depth and other zones of potential significance to liner deployment. In some cases, a circulation bypass system of the downhole liner delivery tool 100 (as described in this disclosure) may be configured to allow circulation through the downhole liner delivery tool 100 when running in or pulling out of the hole.

A size or length of the liner 106 that is stored in the downhole liner delivery tool 100 may be determined according to, for example, hole gauge and running tool dimensions. For example, for an 8.5" hole size, the downhole liner delivery tool 100 may include a 7" O.D. with a 40 ft. running tool length which delivers a 150 ft. liner 106. Liner diameter, both pre and post expansion/inversion, may be determined, for example, by hole gauge and expected washout or maximum hole diameter at a given depth. Liner length may also be determined by the expected section length requiring "sealing," plus an overlap distance uphole and downhole (if applicable) for mechanical integrity.

The first step shown in FIG. 4A may include a liner 106 that is pre-filled with an epoxy. Further, as shown, the downhole liner delivery tool 100 may include an epoxy curing agent 120 that is separated from the liner 106 by a plug 118.

Figure 4B:
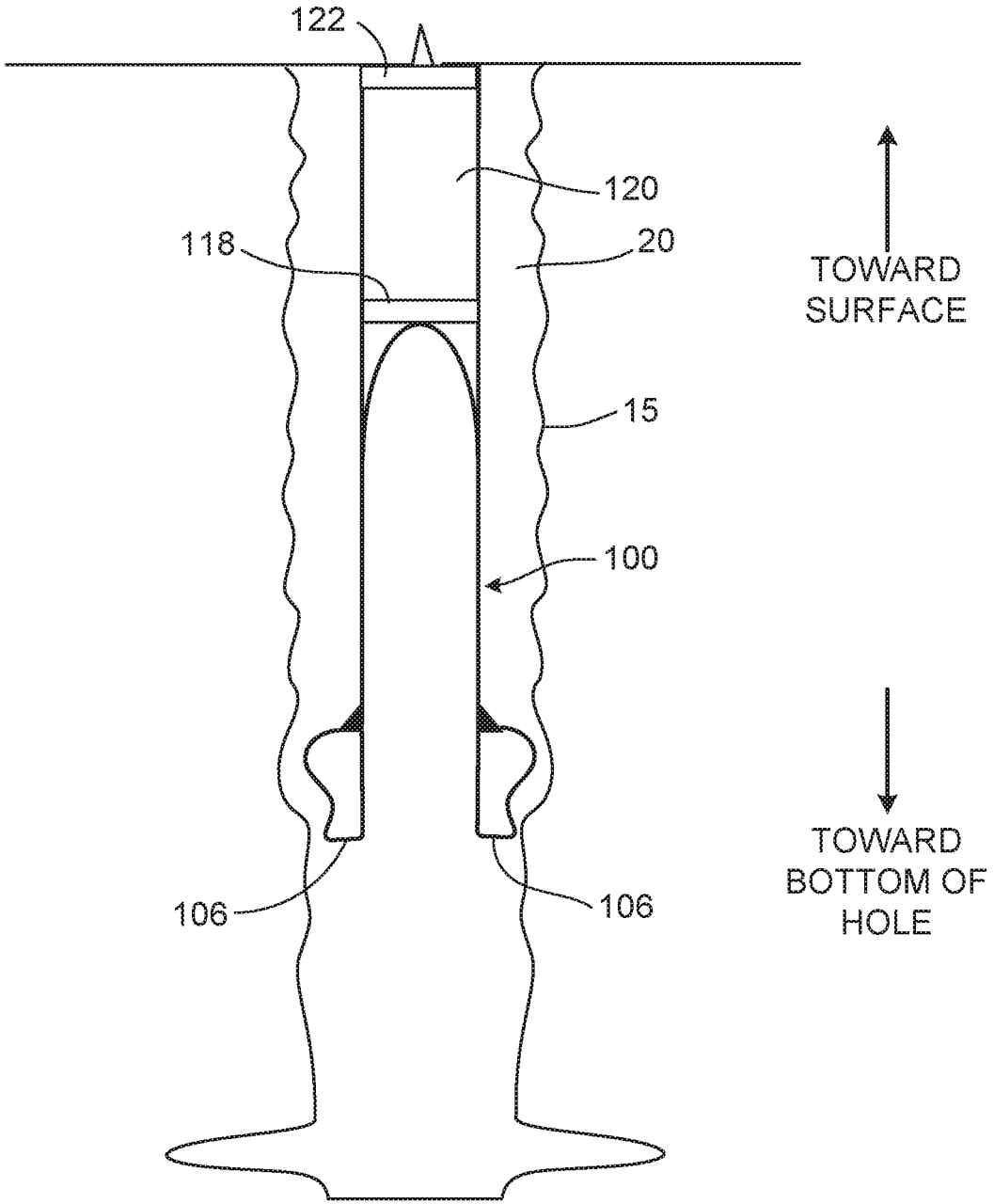

FIG. 4B illustrates a second step in the example process. The liner 106 may be deployed through an application of fluid pressure which, initially activates rupture disk 114 and then begins to force the liner 106 from a liner store of the downhole liner delivery tool 100. In some aspects, a circulation bypass system (as described in this disclosure) acts as a pressure relief system during liner deployment to avoid destroying the liner through over "inflation." Depending on instrumentation and control options, volume pumped and surface standpipe pressure measurements may be adequate guides to the process status. Slowly displacing the fluid from an uphole direction, though the downhole liner delivery tool 100, and into the liner 106 extends liner 106 into annulus 20 by inversion. In some aspects, such as when the liner 106 is coated with an epoxy, the epoxy is placed between the liner 106 and the wellbore 15 through the inversion process, which creates a seal between the liner 106 and the wellbore 15. As part of this step, the plug 118 may be broken or sheared (for example, through fluid pressure), which releases the curing agent about half way through the deployment of the liner 106 (for example, when the plug 118 travels down to reach a shoe at a downhole end of the downhole liner delivery tool 100.

Figure 4C:
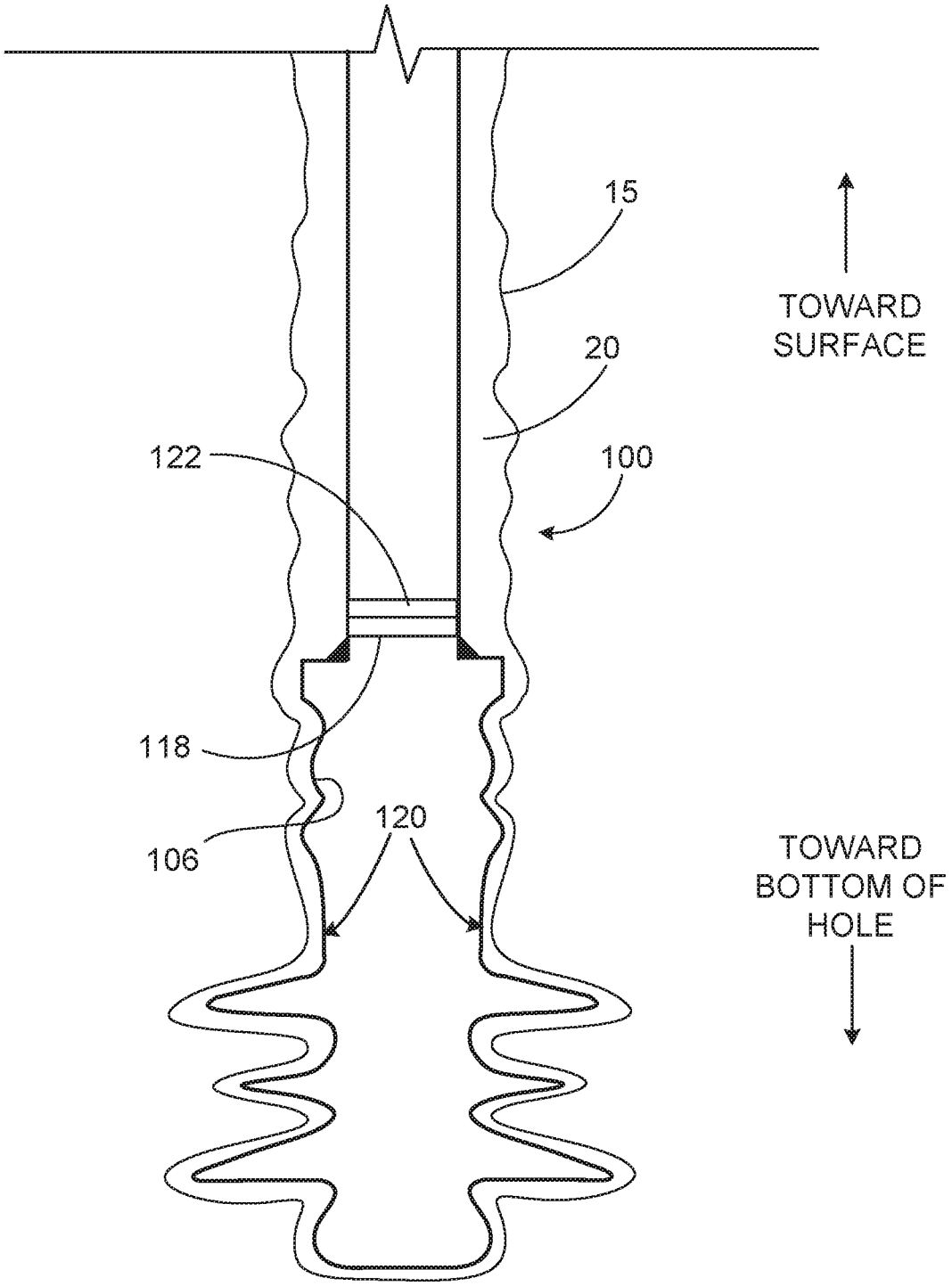

FIG. 4C illustrates a third step in the example process. Once the liner 106 is deployed against the wellbore 15, the curing agent 120 may be pushed into the interior of the liner 106 to react, through the liner 106, with the epoxy. The curing agent 120 may thus, in combination with the epoxy, harden the liner 106 into a permanent barrier. In some aspects, a volume of the fluid needed to expand the liner 106 into contact with the wellbore 15 and a volume of the curing agent 120 may be coordinated (for example, prior to tool deployment) such that a plug 122 that is deigned to push the curing agent 120 into the annulus 20 and into contact with the deployed liner 106 lands at the same time or close to the same time as the liner 106 reaches a full, expanded position (as shown in FIG. 4C).

Figure 4D:
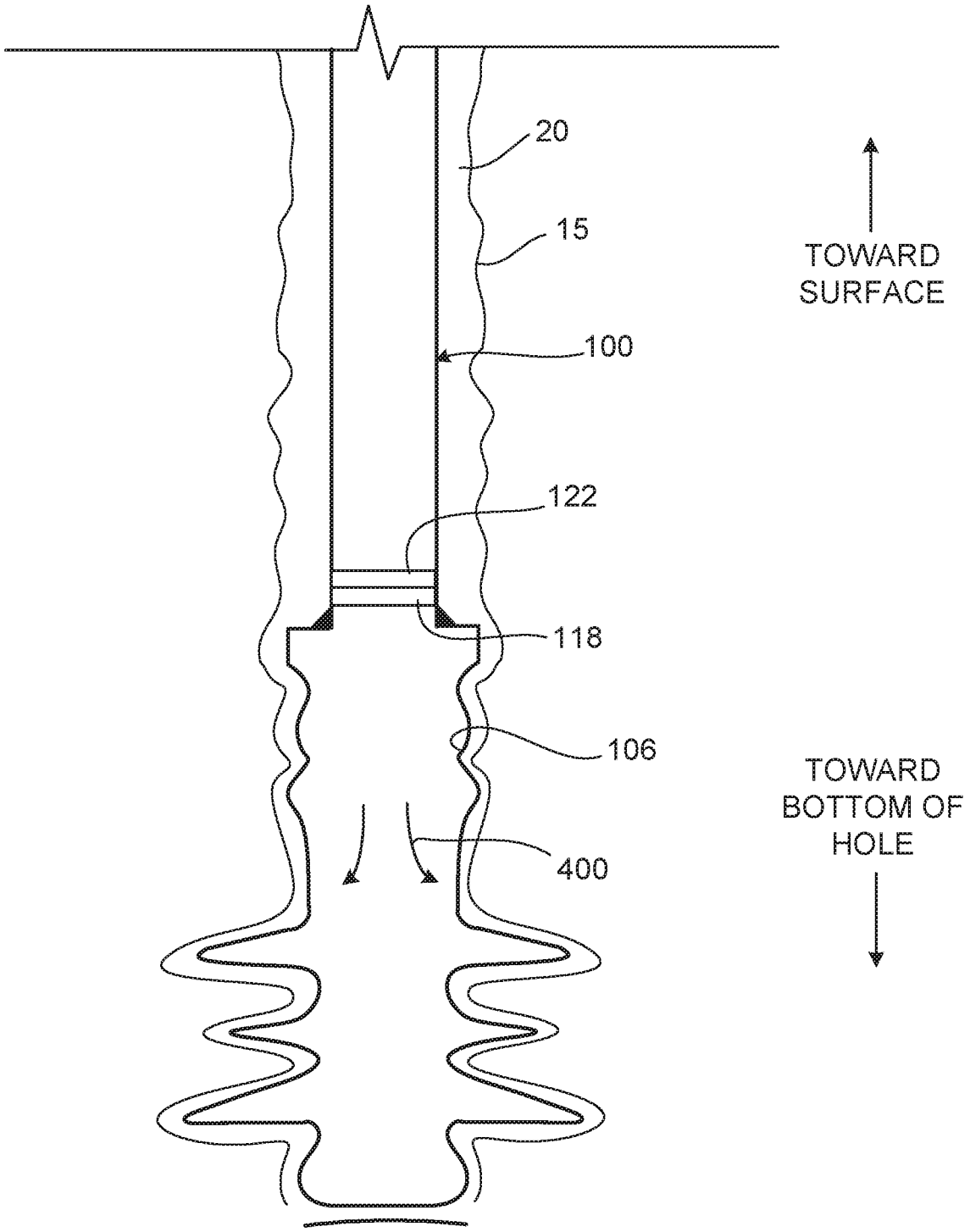

FIG. 4D illustrates a fourth step in the example process. For example, the deployment process may include a sustained overpressure (for example, 500 psi) of a wellbore fluid for an amount of time (for example, hours or more) to ensure that the liner 106 is pushed and sealed to the wellbore 15. This overpressure may also facilitate the deployment of chemicals or resins required to cure the liner 106 (for example, the curing agent 120). At the conclusion of this step, epoxy is sandwiched between the liner 106 and the wellbore 15. In some aspects, one or more plugs may be included within the downhole liner delivery tool 100 to allow hold the overpressure against the liner 106 in the wellbore 15 to ensure that the liner 106 is firmly pressed against the wellbore 15.

Figure 4E:
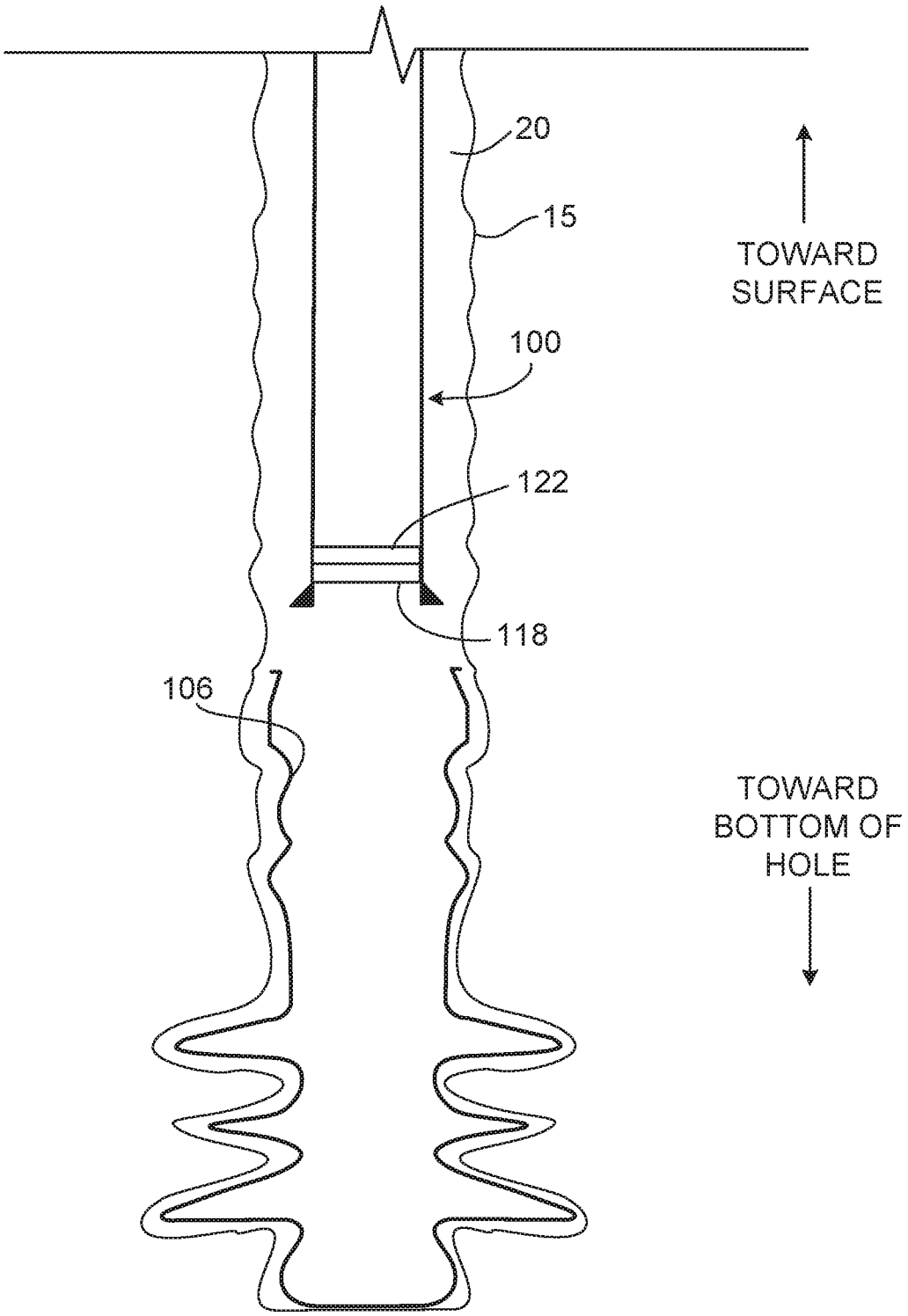

FIG. 4E illustrates a fifth step in the example process. As shown, ends of the liner 106 may be released from the downhole liner delivery tool 100, such as by pulling uphole on the tool to strain the liner 106 beyond yield into failure. In some examples, weak points (for example, locations that have a lower resistance to tearing, breakage, or separation due to, for instance, a thickness or other property of the material) may be designed into portions of the liner 106 (for example, at or near ends of the liner 106) so that the liner 106 may break away once the downhole liner delivery tool 100 is moved uphole. As part of this step, in addition, the downhole liner delivery tool 100 that includes one or more gauge polishers may be run downhole into the wellbore 15 to clean the well and establish a gauge dimension for other operations. The downhole liner delivery tool 100 may then be pulled out of hole and drilling operations may resume with a reduced or mitigated loss of drilling fluid.

While this specification contains many specific implementation details, these should not be construed as limitations on the scope of any claims or of what may be claimed, but rather as descriptions of features specific to particular implementations. Certain features that are described in this specification in the context of separate implementations can also be implemented in combination in a single implementation. Conversely, various features that are described in the context of a single implementation can also be implemented in multiple implementations separately or in any suitable subcombination. Moreover, although features may be described as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system components in the implementations described should not be understood as requiring such separation in all implementations, and it should be understood that the described to program components and systems can generally be integrated together in a single software product or packaged into multiple software products.

A number of implementations have been described. Nevertheless, it will be understood that various modifications may be made without departing from the spirit and scope of the disclosure. For example, example operations, methods, or processes described in this disclosure may include more steps or fewer steps than those described. Further, the steps in such example operations, methods, or processes may be performed in different successions than that described or illustrated in the figures. Accordingly, other implementations are within the scope of the following claims.

What is claimed is:

1. A downhole liner delivery tool, comprising:

a housing configured to couple to a tubular work string, the housing comprising an interior volume;

a liner store enclosed within the interior volume, the liner store configured to enclose at least a portion of a wellbore liner, the wellbore liner comprising a flexible membrane that comprises an imbedded epoxy;

a rupture disk positioned on a downhole axial end of the housing and configured to fluidly isolate the interior volume of the housing from the exterior of the housing and to rupture to expose the liner store to a wellbore; and a hydraulic circulation system arranged in at least a portion of the interior volume and configured to circulate a fluid to expand the wellbore liner from the liner store to an exterior of the housing to contactingly engage a wall of the wellbore.

2. The downhole liner delivery tool of claim 1, wherein the imbedded epoxy is applied to a first surface of the wellbore liner.

3. The downhole liner delivery tool of claim 2, wherein the wellbore liner is positioned in the liner store such that the first surface of the wellbore liner contactingly engages the wellbore wall upon expansion of the wellbore liner from the liner store by the hydraulic circulation store.

4. The downhole liner delivery tool of claim 3, wherein the wellbore liner is arranged in the liner store in a folded position.

5. The downhole liner delivery tool of claim 2, wherein the hydraulic circulation system comprises a fluid channel that extends through the housing, and is configured to receive a wellbore fluid from a terranean surface, direct the wellbore fluid to expand the wellbore liner from the liner store to the exterior of the housing, and direct the wellbore fluid to apply a fluid pressure to a second surface of the wellbore liner that is opposite the first surface of the wellbore liner, to expand the wellbore liner from the liner store to the exterior of the housing.

6. The downhole liner delivery tool of claim 1, wherein the wellbore liner comprises a fibrous mesh.

7. The downhole liner delivery tool of claim 1, further comprising at least one liner clamp coupled to the housing and configured to hold a free end of the wellbore liner during expansion of the wellbore liner from the liner store to the exterior of the housing.

8. The downhole liner delivery tool of claim 7, wherein the at least one liner clamp comprises two liner clamps, each liner clamp configured to hold one of a pair of free ends of the wellbore liner during expansion of the wellbore liner from the liner store to the exterior of the housing.

9. The downhole liner delivery tool of claim 1, further comprising at least one roller guide set positioned in the interior volume to receive a portion of the wellbore liner from the liner store during expansion of the wellbore liner from the liner store to the exterior of the housing.

10. The downhole liner delivery tool of claim 9, wherein the at least one roller guide set comprises a first roller guide set and a second roller guide set, each of the first and second roller guide sets comprising an axis of rotation that is transverse to an axial dimension of the housing.

11. The downhole liner delivery tool of claim 10, wherein the first and second roller guide sets are positioned in proximity to receive the wellbore liner there between from the liner store during expansion of the wellbore liner from the liner store to the exterior of the housing.

12. The downhole liner delivery tool of claim 1, wherein the hydraulic circulation system comprises a fluid piston configured to pressurize a fluid contained in the housing and direct the fluid through the liner store to expand the wellbore liner from the liner store to the exterior of the housing.

13. The downhole liner delivery tool of claim 1, further comprising:

a resin store enclosed within the housing, the resin store comprising a volume of a resin material; and a plug that fluidly separates the resin from the interior volume, the plug configured to break to release the resin to contact the liner.

14. A method for deploying a wellbore liner, comprising running a downhole liner delivery tool into a wellbore on a tubular work string, the downhole liner delivery tool comprising a housing configured to couple to the tubular work string, the housing comprising an interior volume;

circulating a wellbore fluid through the tubular work string to the interior volume of the housing to fluidly contact wellbore liner stored in the downhole liner delivery tool;

fluidly isolating the interior volume of the housing from the exterior of the housing with a rupture disk positioned on a downhole axial end of the housing;

breaking the rupture disk to expose the liner store to the wellbore;

with the circulated wellbore fluid, expanding the wellbore liner from the liner store enclosed within the interior volume, the liner store configured to enclose at least a portion of the wellbore liner, the wellbore liner comprising a flexible membrane that comprises an imbedded epoxy;

circulating the wellbore fluid through a fluid channel that extends through the housing to direct the wellbore fluid to expand the wellbore liner from the liner store to the exterior of the housing; and with the circulated wellbore fluid, deploying the wellbore liner from the liner store to an exterior of the housing to contactingly engage a wellbore wall.

15. The method of claim 14, wherein the imbedded epoxy is applied to a first surface of the wellbore liner.

16. The method of claim 15, wherein the wellbore liner is positioned in the liner store such that the first surface of the wellbore liner contactingly engages the wellbore wall upon expansion of the wellbore liner from the liner store by the hydraulic circulation store.

17. The method of claim 16, wherein the wellbore liner is arranged in the liner store in a folded position.

18. The method of claim 15, wherein the fluid channel is configured to direct the wellbore fluid to apply a fluid pressure to a second surface of the wellbore liner that is opposite the first surface of the wellbore liner, to expand the wellbore liner from the liner store to the exterior of the housing.

19. The method of claim 14, wherein the wellbore liner comprises a fibrous mesh.

20. The method of claim 14, further comprising holding a free end of the wellbore liner during expansion of the wellbore liner from the liner store to the exterior of the housing with at least one liner clamp coupled to the housing.

21. The method of claim 20, further comprising:

holding two free ends of the wellbore liner during expansion of the wellbore liner from the liner store to the exterior of the housing with at least two liner clamps coupled to the housing; and guiding the wellbore liner through at least one roller guide set positioned in the interior volume during expansion of the wellbore liner from the liner store to the exterior of the housing.

22. The method of claim 21, wherein the at least one roller guide set comprises a first roller guide set and a second roller guide set, each of the first and second roller guide sets comprising an axis of rotation that is transverse to an axial dimension of the housing, each of the first and second roller guide sets positioned in proximity to receive the wellbore liner therebetween from the liner store during expansion of the wellbore liner from the liner store to the exterior of the housing.

23. The method of claim 14, wherein the downhole liner delivery tool further comprises a fluid piston configured to pressurize the wellbore fluid contained in the housing and direct the wellbore fluid through the liner store to expand the wellbore liner from the liner store to the exterior of the housing.

24. The method of claim 14, wherein the downhole liner delivery tool further comprises a resin store enclosed within the housing, the resin store comprising a volume of a resin material and a plug that fluidly separates the resin from the interior volume.

25. The method of claim 24, further comprising breaking the plug to release the resin to contact the wellbore liner in the wellbore.

26. The method of claim 14, further comprising:

breaking at least one free end of the wellbore liner; and releasing the wellbore liner into the wellbore.

27. The method of claim 26, wherein breaking at least one free end of the wellbore liner comprises straining a weak point of the wellbore liner beyond a yield limit.

28. The method of claim 26, wherein breaking at least one free end of the wellbore liner comprises adjusting a position of the downhole liner delivery tool toward the terranean surface.

29. A downhole liner delivery tool, comprising:

a housing configured to couple to a tubular work string, the housing comprising an interior volume;

a liner store enclosed within the interior volume, the liner store configured to enclose at least a portion of a wellbore liner, the wellbore liner comprising a flexible membrane that comprises an imbedded epoxy; and a hydraulic circulation system arranged in at least a portion of the interior volume and configured to circulate a fluid to expand the wellbore liner from the liner store to an exterior of the housing to contactingly engage a wellbore wall, the hydraulic circulation system comprising a fluid piston configured to pressurize a fluid contained in the housing and direct the fluid through the liner store to expand the wellbore liner from the liner store to the exterior of the housing.

30. A downhole liner delivery tool, comprising:

a housing configured to couple to a tubular work string, the housing comprising an interior volume;

a liner store enclosed within the interior volume, the liner store configured to enclose at least a portion of a wellbore liner, the wellbore liner comprising a flexible membrane that comprises an imbedded epoxy;

a hydraulic circulation system arranged in at least a portion of the interior volume and configured to circulate a fluid to expand the wellbore liner from the liner store to an exterior of the housing to contactingly engage a wellbore wall;

a resin store enclosed within the housing, the resin store comprising a volume of a resin material; and a plug that fluidly separates the resin from the interior volume, the plug configured to break to release the resin to contact the liner.

31. A method for deploying a wellbore liner, comprising running a downhole liner delivery tool into a wellbore on a tubular work string, the downhole liner delivery tool comprising a housing configured to couple to the tubular work string, the housing comprising an interior volume;

circulating a wellbore fluid through the tubular work string to the interior volume of the housing to fluidly contact wellbore liner stored in the downhole liner delivery tool;

with the circulated wellbore fluid, expanding the wellbore liner from a liner store enclosed within the interior volume, the liner store configured to enclose at least a portion of the wellbore liner, the wellbore liner comprising a flexible membrane that comprises an imbedded epoxy; and with the circulated wellbore fluid, deploying the wellbore liner from the liner store to an exterior of the housing to contactingly engage a wellbore wall, wherein the downhole liner delivery tool further comprises a fluid piston configured to pressurize the wellbore fluid contained in the housing and direct the wellbore fluid through the liner store to expand the wellbore liner from the liner store to the exterior of the housing.

32. A method for deploying a wellbore liner, comprising running a downhole liner delivery tool into a wellbore on a tubular work string, the downhole liner delivery tool comprising a housing configured to couple to the tubular work string, the housing comprising an interior volume;

circulating a wellbore fluid through the tubular work string to the interior volume of the housing to fluidly contact wellbore liner stored in the downhole liner delivery tool;

with the circulated wellbore fluid, expanding the wellbore liner from a liner store enclosed within the interior volume, the liner store configured to enclose at least a portion of the wellbore liner, the wellbore liner comprising a flexible membrane that comprises an imbedded epoxy; and with the circulated wellbore fluid, deploying the wellbore liner from the liner store to an exterior of the housing to contactingly engage a wellbore wall, wherein the downhole liner delivery tool further comprises a resin store enclosed within the housing, the resin store comprising a volume of a resin material and a plug that fluidly separates the resin from the interior volume.

* * * * *